US007484326B2

(12) United States Patent
Tamura et al.

(10) Patent No.: US 7,484,326 B2
(45) Date of Patent: Feb. 3, 2009

(54) DISPLAY APPARATUS

(75) Inventors: Junya Tamura, Tokyo (JP); Tatsuya Haneda, Tokyo (JP)

(73) Assignee: King Jim Co., Ltd., Tokyo (JP)

( * ) Notice: Subject to any disclaimer, the term of this patent is extended or adjusted under 35 U.S.C. 154(b) by 0 days.

(21) Appl. No.: 11/924,824

(22) Filed: Oct. 26, 2007

(65) Prior Publication Data

US 2008/0098639 A1 May 1, 2008

(30) Foreign Application Priority Data

Oct. 26, 2006 (JP) ..... 2006-291185

(51) Int. Cl.
*A47G 1/16* (2006.01)

(52) U.S. Cl. ..... 40/748; 40/756; 248/463; 248/469; 248/472

(58) Field of Classification Search ..... 40/745, 40/747, 748, 753, 754, 756, 124.17, 124.18; 248/463, 469, 472
See application file for complete search history.

(56) References Cited

U.S. PATENT DOCUMENTS 1,892,014 A * 12/1932 Singer et al. ..... 40/748
2,448,580 A * 9/1948 Crosby ..... 248/463
2,542,958 A * 2/1951 Babbitt ..... 248/463
4,515,338 A * 5/1985 Schneider ..... 248/460
4,918,847 A * 4/1990 Lee ..... 40/745
5,570,526 A * 11/1996 Wallon ..... 40/748
6,899,311 B1 * 5/2005 Ternus ..... 248/454
2005/0268511 A1 * 12/2005 Dahlquist ..... 40/754
2008/0028657 A1 * 2/2008 Holmes ..... 40/748

FOREIGN PATENT DOCUMENTS

GB 328 496 5/1930
GB 635 997 4/1950
JP S56-34482 U 4/1981

OTHER PUBLICATIONS

The European Search Report for EP Application No. 07 02 0999; Date of Completion Jan. 8, 2008

* cited by examiner

*Primary Examiner*—Gary C Hoge
(74) *Attorney, Agent, or Firm*—Alston & Bird LLP

(57) ABSTRACT

A display apparatus (1) includes: a plate-like display apparatus main body (2); a leg portion (3) whose upper end is rotatably connected to a rear surface (6) of the display apparatus main body (2) and whose lower end is opened to thereby support the rear surface (6) of the display apparatus main body (2); and an urging mechanism (9) arranged between the display apparatus main body (2) and the leg portion (3) and urging the leg portion (3) so as to open the leg portion (3).

2 Claims, 6 Drawing Sheets

DISPLAY APPARATUS

BACKGROUND OF THE INVENTION

The present invention relates to a display apparatus.

A display apparatus such as a photo frame accommodating a photograph, a picture postcard, or the like for display or a signboard arranged at the store front has on its rear surface a leg consisting of a bar, a plate, or the like for supporting its main body, and the leg can be opened and closed as needed. Apart from this leg structure, there has been developed a leg structure allowing the leg to be put in and out by means of a spring, a claw, or the like (see, for example, Patent Document 1).

[Patent document 1] Japanese Utility Model Application Laid-open No. Sho 56-34482

SUMMARY OF THE INVENTION

In a conventional display apparatus, the leg is allowed to be closed while the display apparatus main body is being raised, so it is necessary to put the display apparatus on a table or the like while opening the leg by hand. Further, when the display apparatus main body is pushed from the front side, the leg is easily allowed to be closed, so the display apparatus is subject to fall while on sale at the store or during cleaning of the table.

In the case of a display apparatus of the type whose leg is not easily closed, when hanging the display apparatus on a wall or putting it in a box, it is necessary to close the leg to enable it to be accommodated, lock the leg with a claw, etc., thus involving an operation which is bothersome.

It is accordingly an object of the present invention to provide a display apparatus whose leg is easily handled.

To achieve the object, the present invention provides a display apparatus which is equipped with an urging mechanism urging the leg portion arranged on the rear surface of the display apparatus main body so as to open the leg.

Specifically, the present invention provides a display apparatus including: a plate-like display apparatus main body; a leg portion whose upper end is rotatably connected to a rear surface of the display apparatus main body and whose lower end is opened to thereby support the rear surface of the display apparatus main body; and an urging mechanism arranged between the display apparatus main body and the leg portion and urging the leg portion so as to open the leg portion.

The display apparatus is equipped with the display apparatus main body, the leg portion, and the urging mechanism. The bottom portion of the plate-like display apparatus main body lacks depth, so it is necessary to provide the leg portion for supporting the rear surface when setting the display apparatus upright on a table or the like. Examples of the display apparatus having such an external configuration include a photo frame and a signboard arranged at the shop front.

The upper end portion of the leg portion is rotatably connected to the rear surface of the display apparatus main body, so it is possible to move the lower end portion thereof toward and away from the display apparatus main body by rotating the leg portion. As a result, it is possible to support the display apparatus main body from behind by opening the leg portion and to reduce the depth dimension of the display apparatus by closing the leg portion.

The urging mechanism is arranged between the display apparatus main body and the leg portion. The urging mechanism applies force so as to open the leg portion. As a result, the leg portion is maintained in the open state even while the display apparatus main body is being raised. Thus, there is no need to open the leg portion by hand when placing the display apparatus on a table or the like. Further, even when the display apparatus main body is pushed from the front side while placed on the table, the leg portion is not easily closed since the leg portion is urged so as to be opened, and thus, the display apparatus main body does not easily fall. Further, the urging mechanism simply urges the leg portion so as to open the leg portion, so when hanging the display apparatus main body on a wall or accommodating the display apparatus main body in a box, the leg portion can be closed solely by pushing it.

Thus, in the display apparatus of the present invention, the handling of the leg is facilitated.

In this case, the leg portion may be rotatably connected to the rear surface of the display apparatus main body through an intermediation of a hinge, and the urging mechanism may urge the leg portion by a spring mounted to a rotation shaft of the hinge.

The upper end portion of the leg portion is connected to the rear surface of the display apparatus main body through the intermediation of the hinge. Thus, it is possible to rotate the lower end portion of the leg portion around the rotation shaft of the hinge. As a result, it is possible to open and close the leg portion connected to the rear surface of the display apparatus main body.

Further, the urging mechanism is formed by the spring mounted to the rotation shaft of the hinge, and is arranged between the display apparatus main body and the leg portion. Thus, one end of the spring pressurizes the display apparatus main body, and the other end of the spring pressurizes the leg portion, whereby it is possible to urge the leg portion so as to open it.

As described above, in the display apparatus of the present invention, it is possible to urge the leg portion so as to open it.

In this case, the leg portion may be urged by the urging mechanism so as to be opened in a free state in which the display apparatus main body is raised.

It is desirable for the leg portion to be open in the free state in which the display apparatus main body is raised. This is because it is bothersome to open the leg portion by hand when placing the display apparatus on a table or the like. On the other hand, when accommodating the apparatus main body, for example, in an accommodating box, it is necessary for the leg portion to be capable of being closed. If the leg portion were fixed in the open state, it would be no longer possible to accommodate the display apparatus in a box or hang the display apparatus on the wall.

In view of this, in the free state in which the display apparatus main body is grasped and raised, a requisite urging force for maintaining the leg portion in the open state is applied to the leg portion.

As a result, by raising the display apparatus main body, the leg portion is brought into the open state. Thus, it is possible for an operator to place the display apparatus main body in an upright state on the table without having to perform the operation of opening the leg portion.

In this case, the leg portion may be urged by the urging mechanism so as to be closed due to a weight of the display apparatus main body both in a state in which the display apparatus main body is placed on a horizontal surface, with the surface thereof on which the leg portion is arranged being on the lower side, and in a state in which the display apparatus main body is installed on a vertical surface, with the surface thereof on which the leg portion is arranged being on the vertical surface side.

It is desirable for the leg portion to be open in the free state in which the display apparatus main body is raised. When the leg portion is open in the free state, it is possible to place the display apparatus on a table or the like without having to perform the operation of opening the leg portion. On the other hand, when accommodating the display apparatus main body in, for example, an accommodating box or installing the display apparatus main body on a wall or the like in a suspended fashion, it is necessary for the leg portion to be closed. If the leg portion were not closed, the display apparatus main body would be allowed to protrude forwards.

In view of this, the urging mechanism is adjusted such that, in a state in which the display apparatus main body is placed on a horizontal surface and in a state in which the display apparatus main body is installed on a vertical surface, the urging mechanism imparts to the leg portion an urging force of a magnitude which will allow the leg portion to be closed by the weight of the display apparatus main body.

As a result, solely by installing the display apparatus main body on a horizontal surface or a vertical surface, it is possible to close the leg portion, which is open in the free state. Thus, the operator can install the display apparatus main body on a wall surface and accommodate the display apparatus main body in an accommodating box without having to perform the operation of closing the leg portion.

In this case, the display apparatus may further include a lock mechanism arranged between the display apparatus main body and the leg portion and adapted to lock rotation of the leg portion caused by the urging mechanism when the leg portion has been opened to a predetermined position suitable for supporting the rear surface of the display apparatus main body.

It is necessary for the leg portion supporting the rear surface of the display apparatus main body to be open at an appropriate position (for example, at amounting position or an opening angle at which the display surface of the display apparatus main body supported by the open leg portion is inclined by approximately 75 degrees with respect to the plane of the table on which it is installed). If the opening angle of the leg portion is larger, the display surface of the display apparatus main body will face upwards, resulting in a deterioration in the display effect. On the other hand, if the opening angle of the leg portion is smaller, the attitude of the display apparatus main body will be rather unstable.

In view of this, the display apparatus of the present invention further includes, between the display apparatus main body and the leg portion, the lock mechanism for stopping the rotation of the leg portion caused by the urging mechanism. When the leg portion has been opened to a predetermined position suitable for supporting the rear surface of the display apparatus main body, the lock mechanism stops the rotation of the leg portion caused by the urging mechanism. As a result, while the display apparatus main body remains raised, the leg portion is kept at a predetermined position suitable for supporting the rear surface of the display apparatus main body, so it is possible to easily place the display apparatus on a table or the like. Further, while the display apparatus is on a table or the like, the leg portion is maintained at a position which is at an opening angle suitable for supporting the display apparatus main body, so it is possible to support the display apparatus main body in a stable condition. The term "predetermined position" implies the positional relationship between the leg portion and the display apparatus main body; for example, it is the position of the leg portion where the display apparatus main body is appropriately supported.

As described above, in the display apparatus of the present invention, it is possible to support the display apparatus main body in a stable manner.

According to the present invention, it is possible to provide a display apparatus whose leg is easily handled.

DETAILED DESCRIPTION OF THE INVENTION

In the following, a best mode for carrying out the present invention will be described by way of example. The following embodiment is only given by way of example, and the present invention is not restricted thereto.

Figure 1:
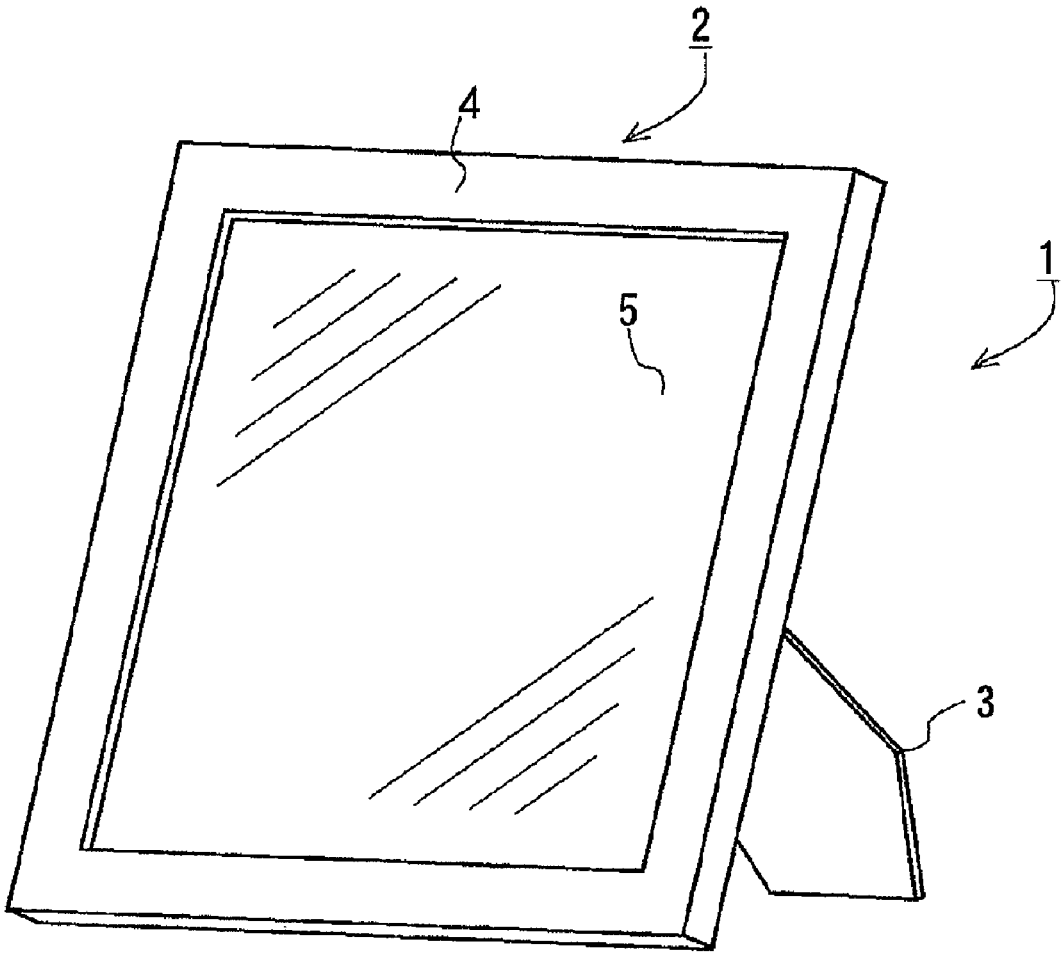
FIG. 1 is a perspective view of a display apparatus of an embodiment as seen from a front side thereof.
Figure 2:
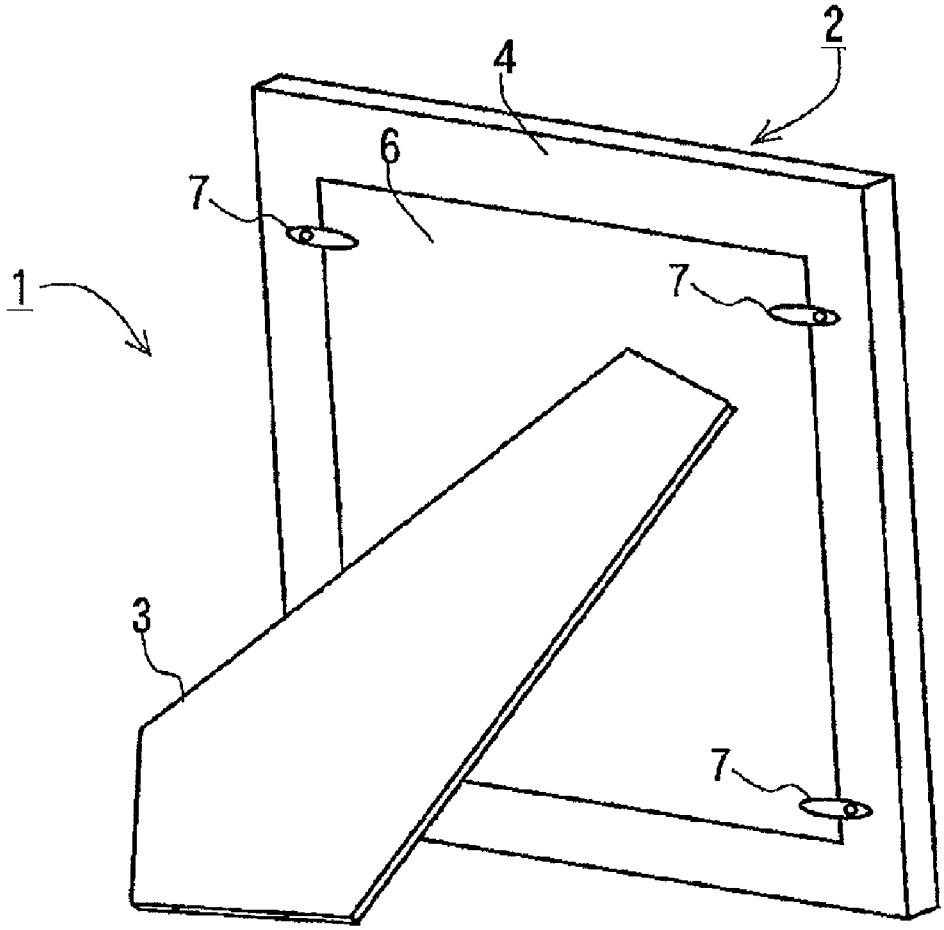
FIG. 2 is a perspective view of the display apparatus of the embodiment as seen from a rear side thereof.

FIG. 1 is a perspective view, as seen from the front side, of a display apparatus 1 according to an embodiment of the present invention. FIG. 2 is a perspective view, as seen from the rear side, of the display apparatus 1 of the embodiment of the present invention. As shown in FIGS. 1 and 2, the display apparatus 1 of the embodiment has a display apparatus main body 2 and a leg portion 3. In the embodiment, the display apparatus 1 is supposed to be a photo frame for displaying a photograph. However, the display apparatus 1 of the present invention is not restricted to a photo frame, and may also be a signboard or the like.

As shown in FIGS. 1 and 2, the display apparatus main body 2 has a frame 4, a protective glass 5, a rear plate 6, and claws 7, and is formed so as to be capable of accommodating a photograph or the like.

Figure 3:
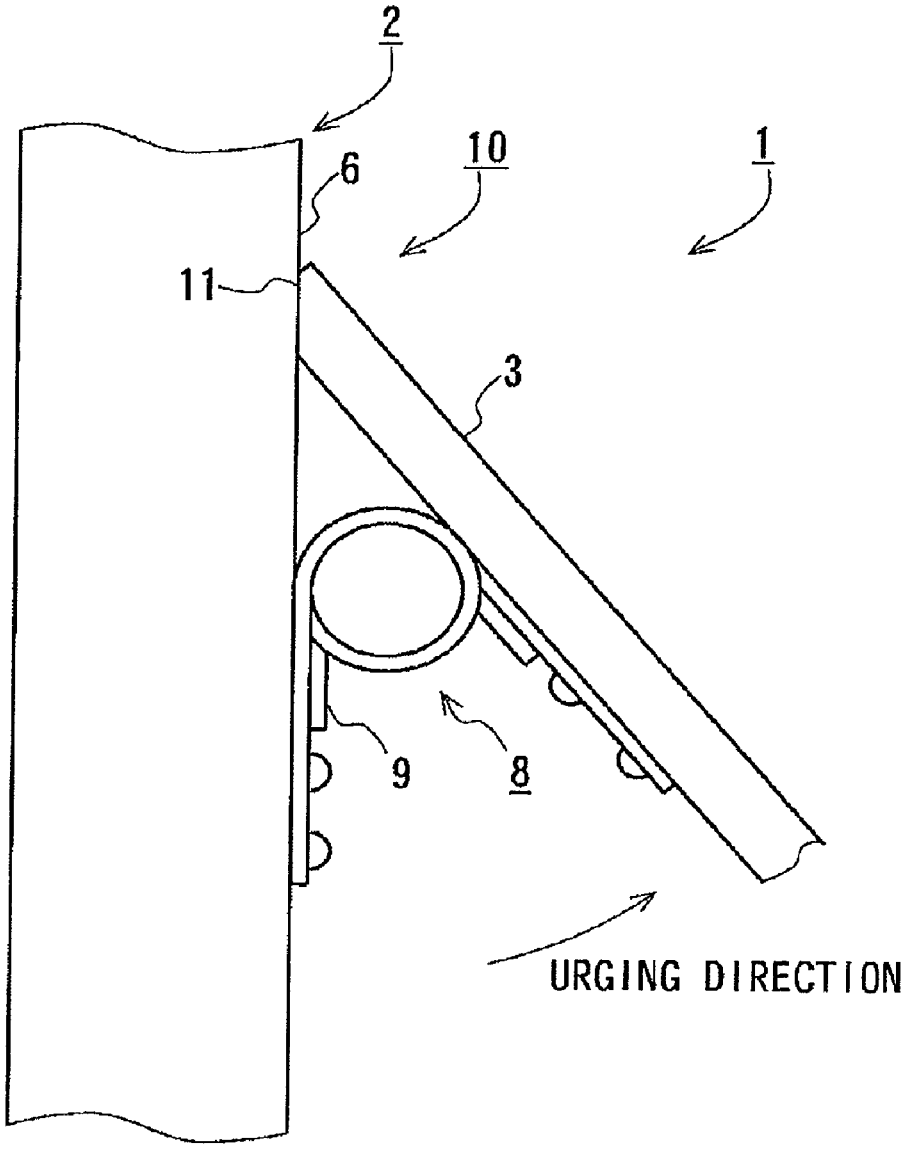
FIG. 3 is a diagram showing how a display apparatus main body and a leg portion of the embodiment are connected together.

As shown in FIG. 2, the leg portion 3 is formed of a plate having a necktie-shaped external configuration. FIG. 3 shows how the display apparatus main body 2 and the leg portion 3 are connected together by a hinge 8. As shown in FIG. 3, the upper end portion of the leg portion 3 is connected to the rear plate 6 at the rear of the display apparatus main body 2 through the intermediation of the hinge 8. The leg portion 3 can rotate about the rotation shaft of the hinge 8, and through the rotation, the leg portion 3 can be opened and closed. By opening the leg portion 3, it is possible to support the display apparatus main body 2 from behind. Further, by closing the leg portion 3, it is possible to diminish the depth dimension of the display apparatus 1.

Figure 4:
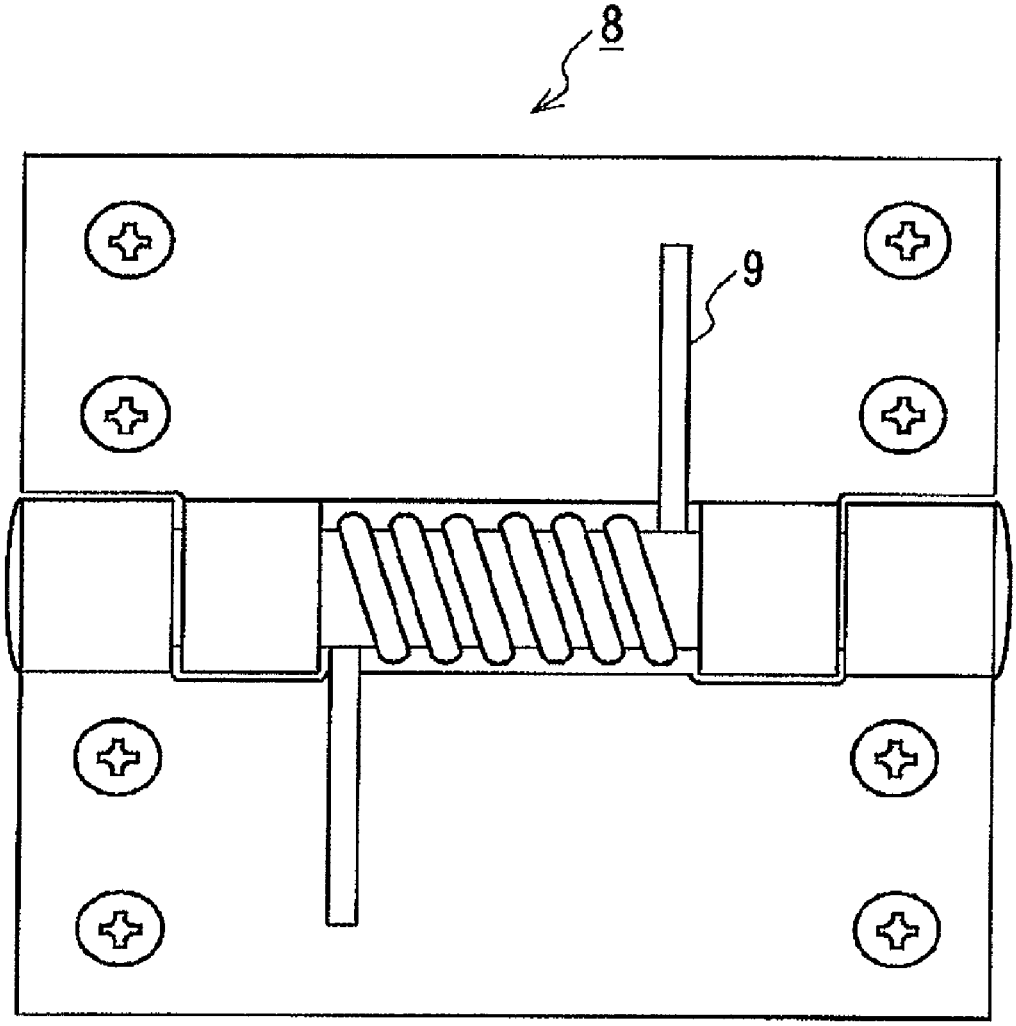
FIG. 4 is a diagram showing a hinge and a torsion spring of the embodiment.

FIG. 4 shows the hinge 8 connecting the display apparatus main body 2 and the leg portion 3 and a torsion spring 9 (which corresponds to the "urging mechanism" of the present invention) mounted to the hinge 8. The hinge 8 having the torsion spring 9 as shown in FIG. 4 is generally called a "spring hinge". As shown in FIG. 3, the hinge 8 to which the torsion spring 9 is mounted is arranged between the display apparatus main body 2 and the leg portion 3, with a torsional force being applied to the torsion spring 9. Thus, the leg portion 3 receives the torsional force due to the torsion spring 9, and is urged in the opening direction to be brought into the open state.

As shown in FIG. 3, between the display apparatus main body 2 and the leg portion 3, there is provided a lock mechanism 10 for stopping the rotation of the leg portion 3 due to the torsion spring 9, causing the leg portion 3 to be locked at a predetermined position suitable for supporting the rear surface of the display apparatus main body 2. In the lock mechanism 10, a distal end portion 11 of the leg portion 3, which is situated still higher than the position thereof where the hinge 8 is connected, abuts the rear surface of the display apparatus main body 2, whereby the rotation of the leg portion 3 is stopped.

Figure 5:
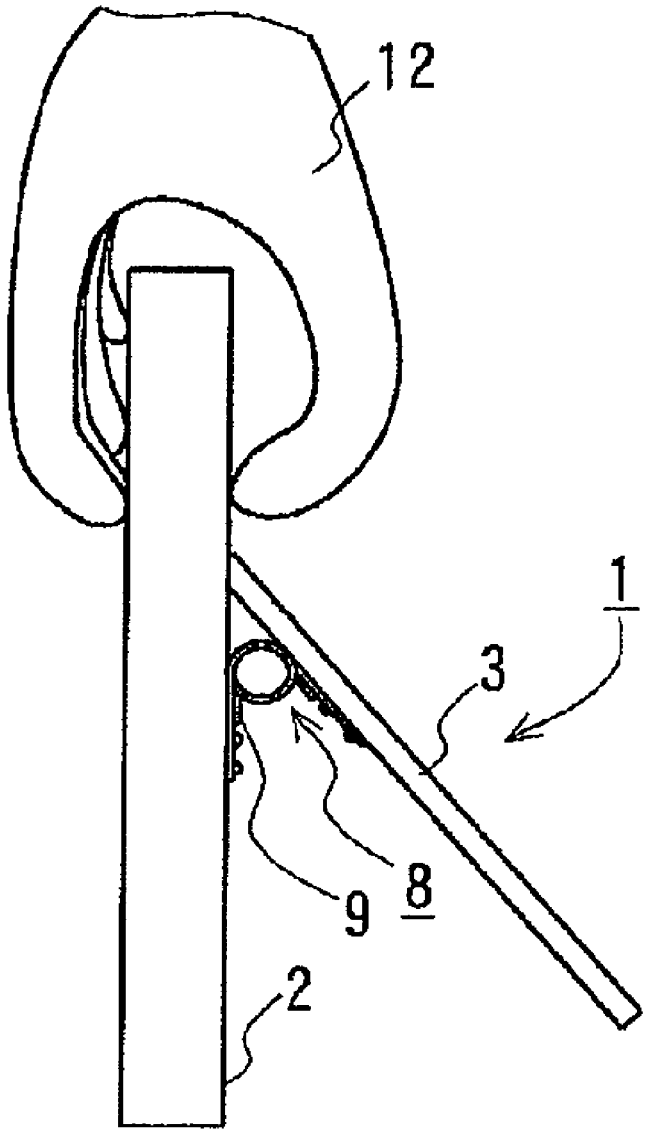
FIG. 5 is a diagram showing the display apparatus main body of the embodiment as raised.

FIG. 5 shows how the display apparatus main body 2 is raised by a hand 12. Since the display apparatus 1 is equipped with the torsion spring 9 urging the leg portion 3 so as to open it, the leg portion 3 is not closed even in the state in which the display apparatus main body 2 is raised. Thus, the display apparatus can be easily placed on a table or the like without having to open the leg portion 3 by the hand 12. Since the leg portion 3 is not closed even when the display apparatus main body 2 is raised, the display apparatus 1 does not easily fall even when it is returned to the showcase by the customer, who has taken it up by the hand 12 when it is on sale at the store.

Figure 6:
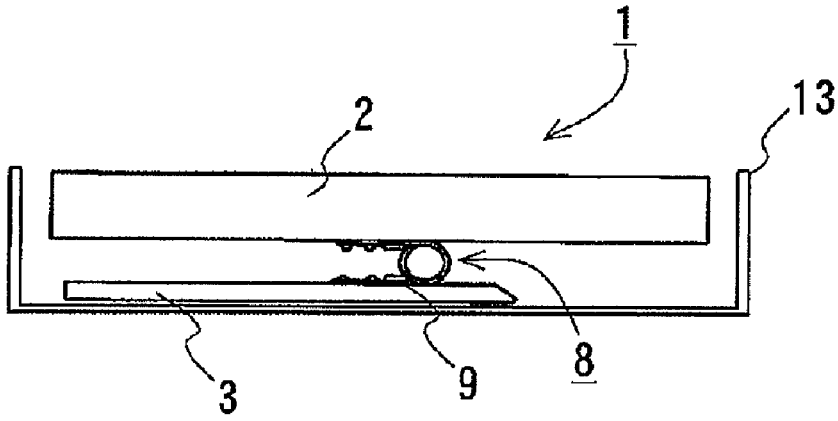
FIG. 6 is a diagram showing the display apparatus main body of the embodiment as accommodated in a box.

FIG. 6 shows the display apparatus 1 as accommodated in a box 13. The leg portion 3 is urged by the torsion spring 9 with a minimum requisite force for opening the leg portion 3. Here, if the urging force due to the torsion spring 9 were too strong, a strong force would be required when closing the leg portion 3. Further, to maintain the leg portion 3 in the closed state, it would be necessary to provide a member or the like for locking the leg portion 3 in the closed state. Here, in the display apparatus 1 of the present invention, there is focused on the difference in weight between the display apparatus main body 2 and the leg portion 3. That is, the display apparatus main body 2, which is formed by the frame 4, the protective glass 5, etc., is heavier than the leg portion 3, which is simply formed by a plate-like member. In view of this, as the torsion spring 9, there is adopted a spring which, while imparting to the leg portion 3 an urging force large enough to open the leg portion 3 in the free state in which the display apparatus 1 is raised, only gives an urging force of up to a magnitude which allows the leg portion to be closed by the weight of the display apparatus 1 both in a state in which the display apparatus 1 is placed on a horizontal surface of an object such as a table or an accommodating box such that the surface (rear surface) of the display apparatus where the leg portion 3 is arranged is on the lower side, and in a state in which the display apparatus 1 is hung on a wall surface. As a result, as shown in FIG. 6, it is possible to cause the leg portion 3 to be closed due to the weight of the display apparatus main body 2 solely by accommodating the display apparatus 1 in the box 13. The leg portion 3 is opened and closed solely by putting the display apparatus in and out of the box 13 without having to perform the operation of opening and closing the leg portion 3, so the display apparatus can be handled very easily. Further, also when hanging the display apparatus 1 on a wall, the leg portion 3 is closed due to the weight of the display apparatus main body 2, so the display apparatus 1 can be hung on the wall as it is without having to perform the operation of opening and closing the leg portion 3.

As described above, in the display apparatus 1 of the embodiment, the leg portion 3 is urged so as to be opened. The leg portion is maintained in the open state unless a predetermined force is applied thereto, and can be easily closed, so the handling of the leg portion 3 is facilitated. While in the embodiment the urging mechanism is constructed by the torsion spring 9, it is also possible to adopt a compression spring, an extension spring, a plate spring, or the like.

The disclosures of Japanese patent application No. JP2006-291185 filed on Oct. 26, 2006 including the specification, drawings and abstract are incorporated herein by reference.

What is claimed is:

1. A display apparatus, comprising:

a plate-like display apparatus main body;

a leg portion whose upper end is rotatably connected by a hinge to a rear surface of the display apparatus main body and whose lower end is opened to thereby support the rear surface of the display apparatus main body;

an urging mechanism comprising a torsion spring arranged between the display apparatus main body and the leg portion and urging the leg portion so as to open the leg portion, wherein the torsion spring is mounted to a rotation shaft of the hinge; and a lock mechanism arranged between the display apparatus main body and the leg portion and adapted to lock rotation of the leg portion caused by the urging mechanism when the leg portion has been opened to a predetermined position suitable for supporting the rear surface of the display apparatus main body, the lock mechanism comprising a distal end of the leg portion that is arranged to abut the rear surface so as to stop the rotation of the leg portion caused by the urging mechanism;

wherein the urging mechanism imparts to the leg portion an urging force of a magnitude that allows the leg portion to be closed by the weight of the display apparatus main body both in a state in which the display apparatus main body is placed on a horizontal surface, with the surface thereof on which the leg portion is arranged being on the lower side, and in a state in which the display apparatus main body is installed on a vertical surface, with the surface thereof on which the leg portion is arranged being on the vertical surface side.

2. A display apparatus according to claim 1, wherein the leg portion is urged by the urging mechanism so as to be opened in a free state in which the display apparatus main body is raised.

* * * * *

UNITED STATES PATENT AND TRADEMARK OFFICE

CERTIFICATE OF CORRECTION

PATENT NO. : 7,484,326 B2
APPLICATION NO. : 11/924824
DATED : February 3, 2009
INVENTOR(S) : Tamura et al.

It is certified that error appears in the above-identified patent and that said Letters Patent is hereby corrected as shown below:

On the title page, item:

(73) Assignee: should read --LaDonna Co., Ltd. and King Jim Co., Ltd.--

Signed and Sealed this

Fifteenth Day of September, 2009

David J. Kappos

David J. Kappos
*Director of the United States Patent and Trademark Office*